United States Patent [19]

Bakula

[11] Patent Number: 4,768,816

[45] Date of Patent: Sep. 6, 1988

[54] MEANS FOR SEALING OR LOCKING A CAM ACTION DOOR FASTENER

[75] Inventor: Robert J. Bakula, Kenosha, Wis.

[73] Assignee: Miner Enterprises Inc., Geneva, Ill.

[21] Appl. No.: 484,857

[22] Filed: Apr. 14, 1983

[51] Int. Cl.[4] ..... E05C 9/18

[52] U.S. Cl. ..... 292/218; 292/205

[58] Field of Search ..... 292/218, 205, 104, DIG. 71

[56] References Cited

U.S. PATENT DOCUMENTS

| | | | |
|---|---|---|---|
| 949,342 | 2/1910 | Williams | 292/104 |
| 1,151,260 | 8/1915 | Flannery | 292/104 X |
| 1,312,931 | 8/1919 | Tenny et al. | 292/205 |
| 1,370,515 | 3/1921 | Brady | 292/104 X |
| 3,212,805 | 10/1965 | Olavder | 292/218 |
| 3,347,583 | 10/1967 | Hallberg | 292/218 X |
| 3,572,794 | 3/1971 | Pastva | 292/218 |
| 3,857,504 | 12/1974 | Bausenbach et al. | 292/DIG. 49 |
| 3,912,312 | 10/1975 | Cerutti | 292/218 |

*Primary Examiner*—Richard E. Moore

*Attorney, Agent, or Firm*—Wood, Dalton, Phillips, Mason & Rowe

[57] ABSTRACT

An improved door fastening system is disclosed for cam-type, or overcenter, locking mechanisms for transport containers and the like. The said improvement providing means for receiving locks or seals at the cam ends of rotatable shaft means and at co-operating keeper means, whereby upon cam-engagement, a government seal or locking means may be received therethrough. The improved system thereby provides tamper-preventive means enabling the detection of vandalism, and further offers a deterrent to unauthorized opening.

10 Claims, 3 Drawing Sheets

MEANS FOR SEALING OR LOCKING A CAM ACTION DOOR FASTENER

BACKGROUND AND SUMMARY OF THE INVENTION

The invention relates to a keeper and cam end of a cam, or overcenter, type door fastener, which provides means for sealing or locking the keeper to the cam end whereby unauthorized opening can be detected or prevented.

The invention is an improvement to a door latching system, such as is described in U.S. Pat. No. 1,925,234 issued Sept. 5, 1933, to Charles E. Dath, assigned to the assignee of this invention and incorporated herein by reference. This type of door latching system is sometimes referred to as an overcenter type fastening mechanism in which a cam end rotates into a fastened position with a cooperating keeper affixed to the door. The cam end is an axial extension of a rotatable shaft, or bar. The rotatable shaft is urged into and out of the cam-type keeper engagement by means of a lever arm.

In normal practice, two rotatable shafts, each having two of the cam ends, are provided for a double-door trailer, cargo container, refrigerator car, and the like. The overcenter type cam action is particularly suitable for such containers, inasmuch as the engagement with the keeper is obtained by pivoting of the cam end. A larger lobe of the cam end engages a recess of the keeper; and as the lever arm rotates in the direction of the door, the large lobe of the cam bears against the keeper recess until the lever handle fully rotates to generally contact the face of the door. At this point, an opposing smaller lobe of the cam end is nested within a forward-opening receiving slot of the keeper. Thus, it will be understood that engagement with the keeper is achieved before the door is fully closed. The cam action draws the door, during its rotation, into a secured position. Even if the lever arm is not fastened to the front surface of the door, by some releasable locking means or the like, the door is yet prevented from opening due to the locking action of the cam end with the keeper.

Other styles of door fasteners, which do not utilize the locking cam action as described, are susceptible to being opened should the lever arm not be secured to the door. This presents a clear vandalism, or theft, problem inasmuch as a simple disengagement of the lever arm, by burglary tools or the like, would grant access to the interior of the cargo container in a very few seconds. Likewise, in the non-camming, non-overcenter type fasteners, should the lever arm accidentally or otherwise be disengaged from the door, the shifting of the cargo load against the doors within the container could easily rotate and open the doors. In the very least, such accidental movement could break the frangible seal usually provided on the fastener and give a false indication of tampering or allow subsequent tampering or theft to go undetected.

One previous provision for securing a door fastener is shown in U.S. Pat. No. 3,572,794, issued to Pastva. A latch member, having two forks, engages projecting portions of a keeper. A vertical pivoting latch is provided to secure one of the forks in a slot of a corresponding projecting member. The latch, however, does not function to prevent or deter opening, but is provided for the practical reason that the latch members at the end of the rotatable bars do not lock with the keeper in an overcenter condition. Without the latch member, the bar end could rotate and disengage from the keeper when an internal force inside of the container pushes the door outwardly. Furthermore, even if the latch and fasteners, which provide no overcenter arrangement, were separately secured to the keeper, such as by a locking pin or the like, the latch would be the only securing force for the rotating bar if the lever arm became disengaged. In the previously mentioned cam-type fastener, the cam end and keeper are in a locked condition at full door closure, distinct from being otherwise locked by a latch. Thus, an inherent safety feature is provided in this type of fastening arrangement. It would, however, be desirable to also eliminate, or at least greatly reduce, the tamperability, or susceptibility to unauthorized opening of the fastener, in addition to providing the cooperative locking effect of the cam end.

It is accordingly the primary goal of the invention to provide a fastener for doors and the like with means for detecting vandalism, preventing unauthorized opening, or both.

It is an important goal of the invention to provide such anti-tampering and anti-theft means without essentially deviating from the effective cam end and keeper locking provisions on the fastener, such as shown in the above-cited U.S. Pat. No. 1,925,234.

It is accordingly a goal of the invention to maintain an overcenter type fastening for doors and the like by providing means for securing a seal in cooperation with the cam end and keeper, which is protected from accidental opening and which, if broken, would be easily detected by visual inspection.

It is a concomitant objective of the invention to provide such an overcenter type fastening device with means in which a padlock, or the like, can be readily received to offer a secure deterrent to unauthorized opening.

It is further a goal of the invention to provide such means whereby both a seal and a lock, such as a padlock or the like, may be used together for both the detection of tampering and for the prevention of unauthorized opening.

Accordingly, the invention entails, in brief summary, an improving modification to cam end and keeper fasteners, such as shown in said U.S. Pat. No. 1,925,234, and further as shown in my co-pending U.S. patent application Ser. No. 369,538. The improvement generally comprises a co-extensive extension of keeper projections, which are spaced apart for receipt therebetween of a second cam lobe of the end member of a rotating shaft. In the preferred embodiment, the extended keeper projections and the lobe member are further formed to wedge together to provide a secure engagement, which stabilizes the fastener and substantially prevents tampering with the fastener. The co-extensive extended keeper projections and the cam lobe are provided with alignable seal and lock receiving means through which a government seal, locking bolt, padlock, or the like, can be extended to seal or lock the fastener in a closed position.

BRIEF DESCRIPTION OF THE DRAWINGS

Further objects and features of the present invention will become more apparent from the following description of an illustrative embodiment of the invention, as shown in the accompanying drawings, wherein.

DESCRIPTION OF THE ILLUSTRATIVE EMBODIMENT

Figure 1:
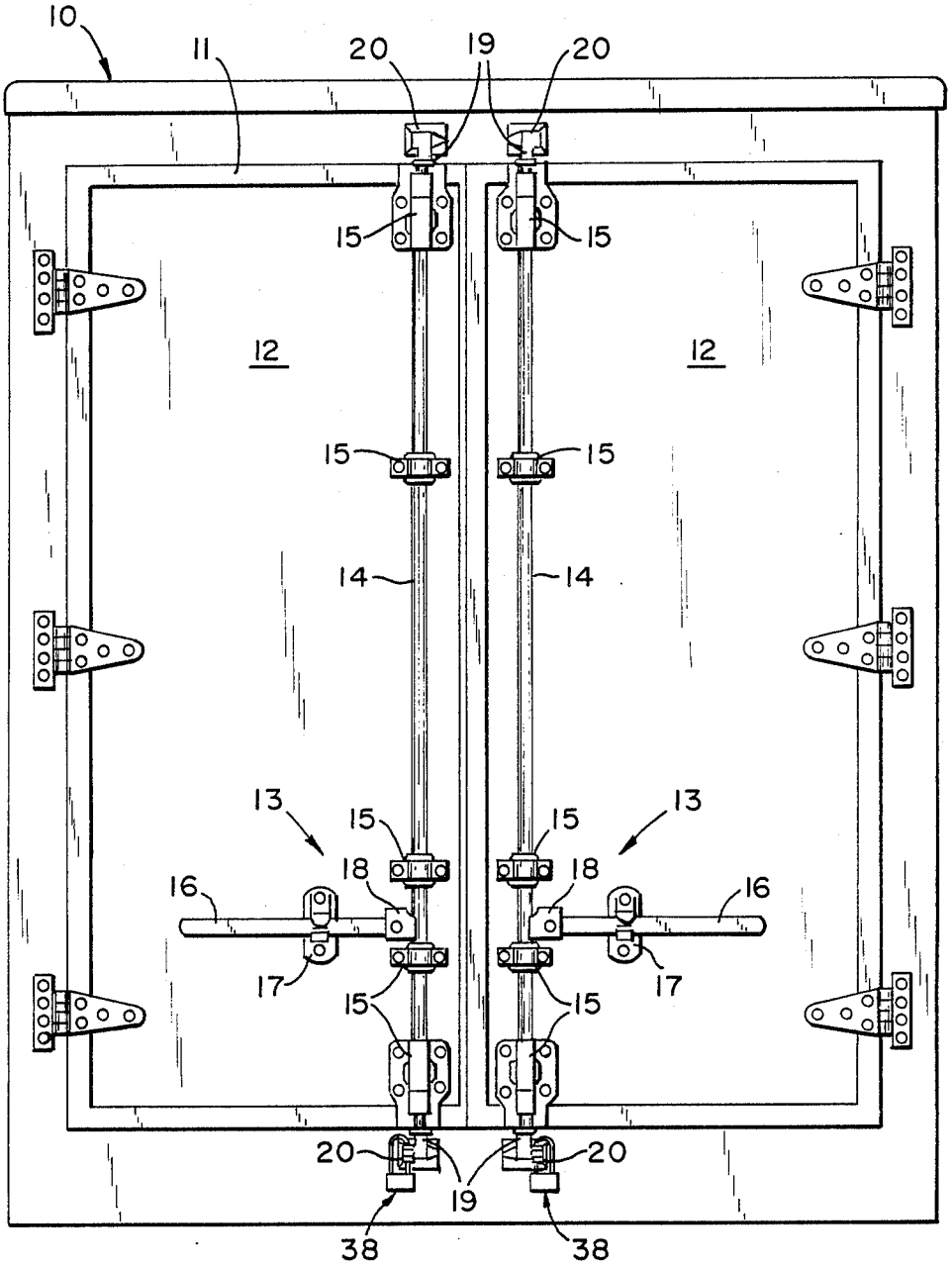
FIG. 1 is a front elevational view of an enclosed container body with a pair of hinged doors, each door being locked by a cam-type door fastening mechanism including the sealing and locking means of the present invention.

FIG. 1 shows a front elevational view of a typical cargo container having an enclosed body 10 and door frame 11. A pair of hinged doors 12 are supported within the frame and are each secured for transport by means of door fastening mechanisms 13.

Door fastening mechanisms 13 have vertically positioned rotatable shafts 14 which are journalled at brackets 15. The rotatable shafts 14 are moved by means of lever arms 16 from the unlocked to the locked position in a known manner. Retainers 17 are fastened to doors 13 and may be provided with means for locking the lever arms in place. Typically, government seals are also utilized at retainer 17 whereby inspection would easily detect tampering when the government seal is removed or damaged. The lever arms are affixed in a movable manner to the rotatable shafts at hinge brackets 18. Hinge brackets 18 provide a pivoting and connecting means whereby the lever arm 16 may be rotated, or pivoted, in a vertical plane out of engagement with retainer 17 and then pulled outwardly so as to rotate shafts 14 and thereby open the container doors 12.

Figure 2:
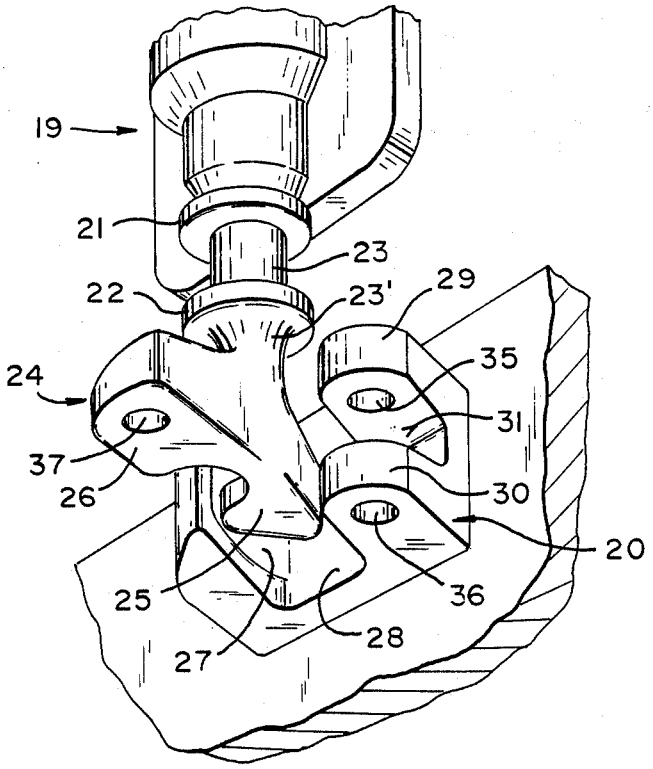
FIG. 2 is an enlarged partial perspective view of the fastening mechanism as shown in FIG. 1, including the means for sealing and locking the keeper and cam end in accordance with the invention shown in an opened position.
Figure 3:
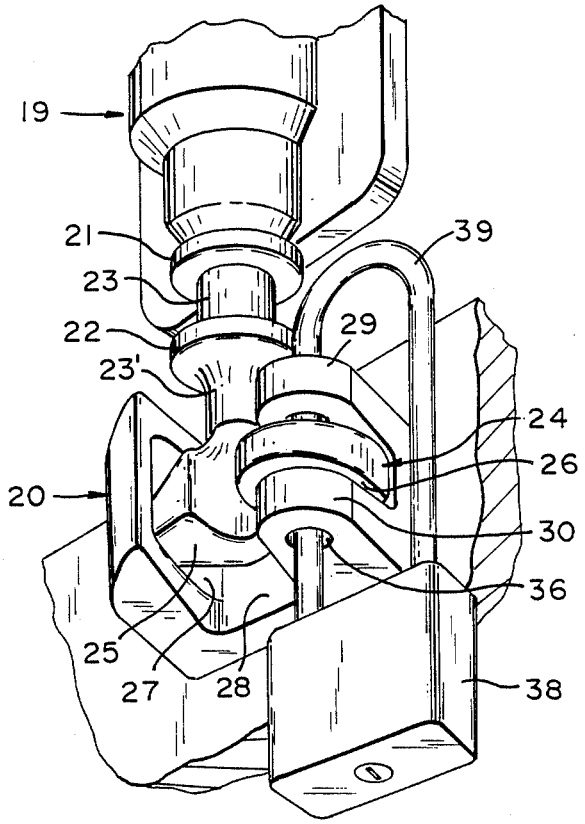
FIG. 3 is a perspective view, substantially the same as in FIG. 2, except that the fastening mechanism is in the closed position with the cam end lockingly engaged with the keeper and a lock, in the form of a padlock, is extended through the sealing and locking means of the invention.
Figure 4:
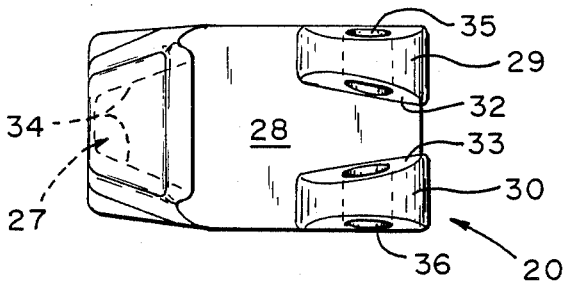
FIG. 4 is a front elevational view of the keeper means as shown in FIGS. 2 and 3.
Figure 5:
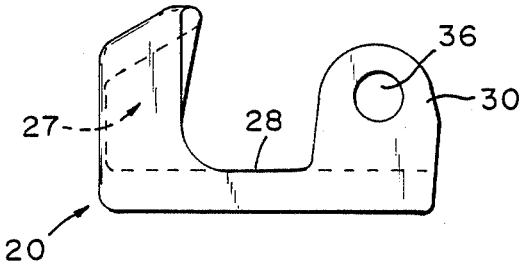
FIG. 5 is a bottom plan view of the keeper as shown in FIG. 4.
Figure 6:
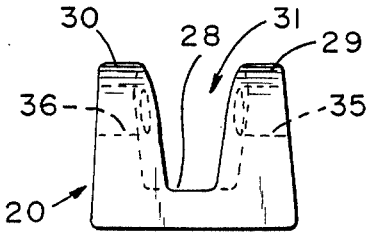
FIG. 6 is a side elevational view of the keeper as shown in FIG. 5.
Figure 7:
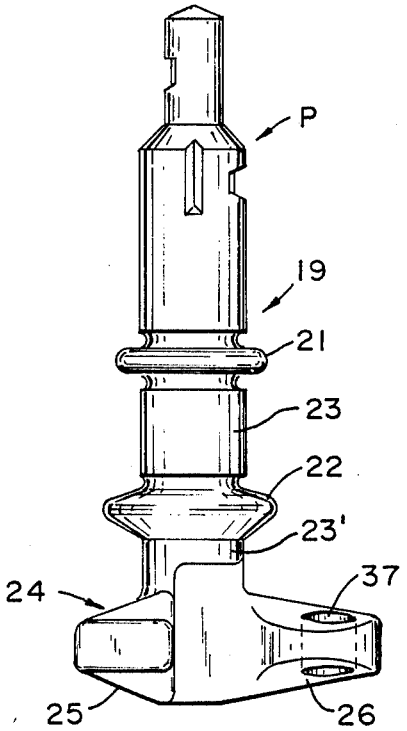
FIG.7 is a front elevational view of the end portion of a rotatable shaft, as shown in FIG. 1, including the cam-end portion thereof having the improved structure of the invention for sealing and locking engagement with the keeper as shown in FIGS. 2–6; and, FIG. 8 is a bottom view of the cam end of the rotatable shaft shown in FIG. 7.

As more specifically shown in FIGS. 2, 3 and 7, end sections 19 are provided at the opposite ends of each rotatable shaft 14. Preferably, end sections 19 are integrally cast or forged members that are provided with a terminal pin end P, which is secured within the hollow rotatable shafts 14 (See FIG. 7). However, end portions 19 may be integrally formed with the rotatable shafts 14, if desired.

As seen in FIG. 1, keepers 20 are affixed in vertical alignment with the end sections 19 above and below the door frame 11. Each end section 19 is provided to engage the adjacent keeper 20 to secure the doors 12 in a closed position, as will be explained hereinafter.

Collars 21 and 22 form a portion of end section 19 and are separated by a shaft portion 23 therebetween. The shaft portions 23 are journalled in the top and bottom journal brackets 15, as seen in FIG. 1. The positioning of the collars 21 and 22 at opposite sides of the journal bracket 15 retain shafts 14 on the doors and prevents vertical dislocation of the shafts 14 and end sections 19.

It will be understood that the end section 19 shown in FIGS. 2, 3 and 7, is shown for one lower end of a fastening mechanism 13, but is a mirror-image of the other sections 19 at the top of the shaft 19, as seen when viewing FIG. 1.

Collar 22 is integrally formed with shaft portion 23 on one side and a shaft extension portion 23' on the other side. Shaft extension 23' widens and is integrally formed with a cam end 24, which forms the lowermost portion of end section 19, as viewed in FIG. 2.

The overcenter cam operation of cam end 24 within keeper 20 is essentially the same as explained in U.S. Pat. No. 1,925,234, issued to Dath, as cited above. Cam end 24 includes a first cam lobe 25 and an opposite second cam lobe 26. First cam lobe 25 is received within keeper recess 27 which has a "negative" or female shape conforming closely to the "positive" or male shape of cam lobe 25. A rear wall means 28 of the keeper 20 provides an affixation means for fastening keepers 20 to the enclosed body 10.

The cam end 24 engages with the keeper recess 27 when the shaft 14 is rotated to the right in FIG. 2. As the shaft 14 and end section 19 proceed into position shown in FIG. 3, the cam end 24 forcefully cams the end section 19 into an overcenter position against the outer flat surface of recess 27. The cam end 24 and keeper recess 27 thereby operate to retain the end section 19 in a closed position with respect to the keeper 20, as illustrated in FIG. 3.

In accordance with this invention, the front portion of the keeper 20 is provided with spaced-apart outward projections 29, 30. The projections are spaced apart to form a slot 31 for receiving the second cam lobe 26. The arrangement of lobe 26 and the projections 29, 30 provide the improved sealing or locking means for the door fastener of the present invention. Projections 29, 30 extend outwardly from rear wall means 28 a sufficient distance to accommodate substantially the entire lobe 26 portion of cam end 24 therebetween.

As shown in more detail in FIGS. 4–8, recess 27 of keeper 20 includes coverging walls 34 to accommodate the wedge-like shape of the lobe 25. Similarly, the opposing faces of projections 29 and 30 are provided with bevelled surfaces 32, 33, respectively, which accommodate, in a like manner, the tapered or wedge shape of lobe 26. Accordingly, when first lobe 25 and second lobe 26 are rotated into the locked position, the converging walls 34 at one side, and the opposed bevelled surfaces 32, 33 on the other side, securely grip the cam lobes 25 and 26 as the shaft 14 rotates to move the cam end 24 into locking engagement with the associated keeper 20.

In accordance with this invention, the extended projections 29, 30, and the second lobe 26 are provided with means to seal and/or lock the cam end 24 in this closed position. To accomplish this purpose, the projections 29, 30 are provided, respectively, with apertures 35, 36, extending therethrough. Also, an aperture 37 extends through the second lobe 26, and is oriented such that at full engagement of the cam end 24 with the keeper 20 the lobe aperture 37 vertically aligns with apertures 35 and 36.

As best viewed in FIG. 3, upon the full engagement of the components in the locked position, a lock 38 may be affixed to the cam end 24 and keeper 20 by extending the lock hasp 39 through the aligned apertures 35, 36, 37. Alternatively, a government seal may be passed through these aligned apertures so that if tampering with the fastening mechanisms occur, it would easily be detected by visual inspection of the seal's altered condition. Concealment of a broken seal is not readily achieved, but a padlock, for example, could be repositioned so as to simulate a perfectly locked condition after unauthorized opening. To guard against such a possibility, both a lock means and a seal means may be provided to extend through the aligned apertures 35,36 and 37, such that tampering with the lock, which might otherwise be concealed by a vandal, would nonetheless be detected by visually noting any damage to the government seal.

Figure 8:
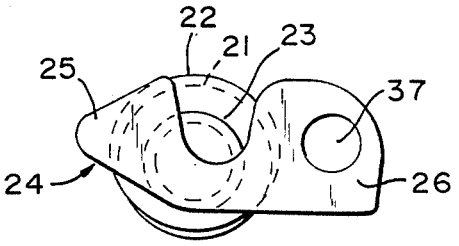

Referring to FIGS. 3 and 8, it is apparent that the forward surfaces of cam end 24, including the lobes 25 and 26, and the projections 29, 30 on the opposite end of keeper 20, are substantially co-extensive in a horizontal direction. Accordingly, the invention provides for a sealing and locking improvement to an overcenter door closing mechanism that does not substantially deviate from the well-accepted compact shape of such mechanisms. No potentially dangerous protrusions are provided, and no radically different method of operation of this type of fastening mechanism is required to fulfill the goals of the invention. As seen in FIG. 8, the compact design of the fastener is preserved in a locked position by preferably arranging the second lobe 26 to be co-extensive with the projections 29 and 30.

Accordingly, there has been provided an improved overcenter cam engaging door fastening mechanism, whereby sealing and or locking of the door may be simply and securely accomplished to prevent unwanted rotation of the cam end 24 with respect to the keeper 20 during transportation and handling of the associated container.

What is claimed is:

1. In a transportation container having a door frame and at least one door, and further having a cam-type door fastening mechanism, an improved system for releasably securing said fastening mechanism in a closed position, said system comprising:

keeper means mounted on the frame and including a cam-receiving portion and a pair of projections laterally spaced from the cam receiving portion and extending outwardly from a wall means in a horizontal direction to terminate generally co-extensively and being spaced apart to form a recess having a selected shape therebetween;

means provided in said projections in generally vertical alignment for receiving releasable locking or sealing means;

rotatable shaft including a first cam lobe projecting from one side of the shaft means for engaging with said cam-receiving portion of said keeper means and a second lobe projecting from the opposite side of the shaft means for positioning between said keeper projections, said first cam lobe being operative to cam said door in a closed position and to move to an overcenter position against said cam-receiving portion of said keeper means, and said second lobe having means for receiving said releasable locking or sealing means, which vertically aligns with said means in said projections when said door is in said closed position and said first cam lobe is in said overcenter position, whereby said vertically aligned means may receive therethrough said means for releasably locking or sealing said cam lobes and keeper.

2. The improvement as in claim 1 wherein the second lobe and the projecting extensions of the keeper means are generally co-extensive in the horizontal direction at cam engagement.

3. The improvement as in claim 2 wherein said projections have opposing surfaces capable of wedge-like engagement with said second cam end lobe.

4. The improvement as in claim 3 wherein said opposed surfaces of said projections are bevelled and said second lobe is correspondingly tapered, whereby said tapered second lobe and bevelled surfaces of said projections cooperate to wedge-like engage said lobe between said projections upon cam engagement with the keeper means.

5. The improvement as in claim 1 wherein said cam lobes are integrally formed with opposite end sections of the rotatable shaft means.

6. The improvement as in claim 5 wherein said end sections are separable from said shaft means and insertable at opposite ends of the rotatable shaft means.

7. The improvement as in claim 5 wherein said end sections are integrally formed with the rotatable shaft means.

8. A door fastening mechanism for transport containers having a door frame and at least one door supported in said frame for closure of the container, said mechanism comprising:

keeper means affixed above and below said door frame;

at least one rotatable shaft means vertically journalled in aligned position between said keeper means;

said rotatable shaft means terminating at said keeper means, at opposite ends thereof, in cam engageable end sections having at one side a first cam lobe for engaging with a cam receiving portion of said keeper means to move into an overcenter position against said cam receiving portion of said keeper means, said first cam lobe being integrally formed with a second cam lobe at the opposite side of the end section;

said cam lobe having a selected shape and including means for receiving a releasable locking or sealing means;

said keeper means including a pair of spaced-apart and outwardly extending projections forming a recess therebetween for receipt of the second cam lobe, said projections having means for receiving a releasable locking or sealing means which vertically aligns with said means of the second lobe upon engagement of the cam end sections with said keeper means and the first cam lobe in said overcenter position.

9. The fastening mechanism as in claim 8 wherein said second cam lobe and said pair of outwardly extending keeper projections terminate substantially co-extensively in a horizontal direction outwardly of said door.

10. A door fastening mechanism for transport containers having a door frame and at least one door supported on the frame for closure of the container, comprising:

keeper means affixed to the door frame and including a cam receiving portion and a laterally spaced lock receiving portion both of which project outwardly from a wall means; and rotatable shaft means terminating in an end section having at one side a cam lobe for engaging with said cam receiving portion of said keeper means to cam said door into a closed position and to move said cam lobe into an overcenter position against said cam receiving portion of said keeper means, and the opposite side of said end section having a lock receiving portion which vertically aligns with the lock receiving portion of said keeper means when the door is in said closed position and the cam lobe is in said overcenter position.

* * * * *